US010087918B2

(12) United States Patent
Okuno et al.

(10) Patent No.: US 10,087,918 B2
(45) Date of Patent: Oct. 2, 2018

(54) COMPRESSOR

(71) Applicant: Kobe Steel, Ltd., Kobe-shi (JP)

(72) Inventors: Takashi Okuno, Takasago (JP); Kenji Nagura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/938,279

(22) Filed: Nov. 11, 2015

(65) Prior Publication Data

US 2016/0169216 A1 Jun. 16, 2016

(30) Foreign Application Priority Data

Dec. 11, 2014 (JP) ..... 2014-250856

(51) Int. Cl.

| | |
|---|---|
| ***F04B 25/00*** | (2006.01) |
| ***F04B 25/02*** | (2006.01) |
| ***F04B 39/00*** | (2006.01) |
| ***F04B 39/12*** | (2006.01) |
| ***F04B 39/14*** | (2006.01) |
| ***F04B 49/12*** | (2006.01) |
| ***F04B 25/04*** | (2006.01) |
| ***F04B 27/12*** | (2006.01) |
| ***F04B 53/14*** | (2006.01) |

(52) U.S. Cl.

CPC ..... *F04B 25/005* (2013.01); *F04B 25/02* (2013.01); *F04B 25/04* (2013.01); *F04B 27/12* (2013.01); *F04B 39/0094* (2013.01); *F04B 39/126* (2013.01); *F04B 39/14* (2013.01); *F04B 49/123* (2013.01); *F04B 53/14* (2013.01)

(58) Field of Classification Search

CPC ..... F04B 25/00; F04B 25/02; F04B 25/005; F04B 25/04; F04B 3/00

USPC ..... 92/152; 417/266, 265, 268

See application file for complete search history.

(56) References Cited

U.S. PATENT DOCUMENTS 159,533 A * 2/1875 Westinghouse, Jr. ... F04B 25/02 417/266

745,298 A 11/1903 Sergeant et al.

(Continued)

FOREIGN PATENT DOCUMENTS

| | | | | |
|---|---|---|---|---|
| FR | 1406476 | | 7/1965 | |
| GB | 190888 A | * | 1/1923 | ..... F04B 25/02 |
| JP | 2014-020284 | | 2/2014 | |

OTHER PUBLICATIONS

Extended European Search Report dated Apr. 28, 2016 in Patent Application No. 15194978.1.

*Primary Examiner* — Thomas E Lazo
*Assistant Examiner* — Michael Quandt
(74) *Attorney, Agent, or Firm* — Oblon, McClelland, Maier & Neustadt, L.L.P.

(57) ABSTRACT

A compressor of the present invention comprises a crankshaft, a first compression part, and a second compression part for further compressing a gas discharged from the first compression part. The first compression part comprises a first reciprocating motion conversion part, a first pressing part, and a first cylinder body comprising a plurality of cylinder components, while the second compression part comprises a second reciprocating motion conversion part, a second pressing part, and a second cylinder body comprising a plurality of cylinder components. The number of the cylinder components of the second cylinder body is smaller than that of the cylinder components of the first cylinder body.

16 Claims, 4 Drawing Sheets

(56) References Cited

U.S. PATENT DOCUMENTS

| | | | | | |
|---|---|---|---|---|---|
| 1,224,661 | A * | 5/1917 | Parker | F04B 49/007 | 417/213 |
| 1,417,571 | A * | 5/1922 | Riesner | F04B 25/02 | 417/243 |
| 1,467,489 | A * | 9/1923 | Nordberg | F04B 25/02 | 417/248 |
| 1,566,308 | A | 12/1925 | Carpenter | | |
| 1,936,167 | A * | 11/1933 | Kniskern | C01C 1/0405 | 252/377 |
| 2,373,779 | A * | 4/1945 | Ricardo | F04B 25/00 | 417/265 |
| 2,666,571 | A | 1/1954 | Chabay | | |
| 6,688,854 | B2 * | 2/2004 | Sakamoto | F04B 25/00 | 417/244 |

* cited by examiner

COMPRESSOR

BACKGROUND OF THE INVENTION

Field of the Invention

The present invention relates to a compressor for compressing a gas.

Description of the Related Art

A reciprocation type multistage compressor has been conventionally known. For example, JP2014-020284 A discloses a compressor, which comprises a low-stage side compression part and a high-stage side compression part for further compressing a gas compressed in the low-stage side compression part. The low-stage side compression part comprises a first cylinder having a first compression chamber and a first piston for compressing a gas in the first compression chamber. The high-stage side compression part comprises a second cylinder having a second compression chamber, a second piston for compressing a gas in the second compression chamber, and a plurality of piston rings fixed to the second piston.

In a reciprocation type multistage compressor, having a plurality of compression chambers formed in a cylinder, there is a difficulty in processing if a cylinder is to be formed from a single member. To circumvent this, it is considered to form a cylinder from a plurality of divided bodies.

In order to form a cylinder from a plurality of divided bodies, however, a cylinder is assembled in consideration of variation of inner and outer diameters of the each divided body, making it difficult to minimize the width of a very small gap (hereinafter referred to as "minute gap") formed between an outer peripheral surface of a piston and an inner peripheral surface of a cylinder at a front end side of the cylinder after assembling. It will be more difficult to minimize the width of the minute gap if a piston is also formed from a plurality of divided bodies.

On the other hand, a compression chamber, in which a high-pressure gas is introduced (hereinafter referred to as "high-pressure compression chamber"), is more likely to leak a gas as compared to a compression chamber, in which a low-pressure gas is introduced. The high-pressure compression chamber, therefore, is required to minimize the width of the minute gap mentioned above as much as possible.

The present invention was made in view of the problems described above, and it is an object thereof to minimize the width of a minute gap between a cylinder component and a pressing part.

SUMMARY OF THE INVENTION

As a means for solving the above problems, the present invention provides a compressor comprising a crankshaft, a first compression part for compressing a gas, and a second compression part for further compressing the gas discharged from the first compression part, wherein:

the first compression part comprises a first reciprocating motion conversion part connected to the crankshaft, linearly reciprocating with a rotation of the crankshaft, a first pressing part connected to the first reciprocating motion conversion part, capable of compressing a gas, and a first cylinder body for storing the first pressing part, the first cylinder body comprising a plurality of cylinder components mutually fitted together in a state of being arranged along a moving direction of the first pressing part, a plurality of compression chambers being arranged corresponding to the plurality of cylinder components, allowing a gas compression by the first pressing part; and the second compression part comprises a second reciprocating motion conversion part connected to the crankshaft, linearly reciprocating with a rotation of the crankshaft, a second pressing part connected to the second reciprocating motion conversion part, capable of compressing a gas, and a second cylinder body for storing the second pressing part, the second cylinder body comprising a plurality of cylinder components mutually fitted together in a state of being arranged along a moving direction of the second pressing part, a plurality of compression chambers being arranged corresponding to the plurality of cylinder components, allowing a gas compression by the second pressing part, wherein the number of the cylinder components of the second cylinder body is smaller than that of the cylinder components of the first cylinder body.

According to the present invention, a compressor can be configured to be advantageous by minimizing the width of a minute gap between a cylinder component and a pressing part in a compression chamber, in which a higher pressure gas is introduced.

In this configuration, it is preferred that the first compression part further comprises a plurality of first ring member groups disposed between inner peripheral surfaces of the plurality of cylinder components and the first pressing part and the second compression part further comprises a plurality of second ring member groups disposed between inner peripheral surfaces of the plurality of cylinder components and the second pressing part.

Having such a configuration can suppress the leakage of a gas out of the each compression chamber.

Further, in this configuration, it is preferred that a stroke of the second pressing part is set to be smaller than that of the first pressing part.

In this embodiment, the wear of the second ring member groups is reduced by setting the stroke of the second pressing part to be smaller than that of the first pressing part, whereby the leakage of a gas out of the second ring member groups, which are exposed to a gas at a higher pressure than the first ring member groups, can be further reduced.

Further, in the present invention, it is preferred that the plurality of the first ring member groups are fitted in a plurality of annular groove parts formed on outer peripheral surfaces of the first pressing part and the plurality of the second ring member groups are fitted in a plurality of annular groove parts formed on outer peripheral surfaces of the second pressing part.

Having such a configuration can reduce the wear of the ring member groups as compared to a case where the ring member groups are attached to cylinder component sides.

Further, in the present invention, the number of the plurality of compression chambers of the second compression part is preferably two.

Having such a configuration can more reliably minimize the width of the minute gap mentioned above in the second compression part for compressing a high-pressure gas.

Further, in the present invention, it is preferred that the plurality of cylinder components of the first cylinder body and the plurality of cylinder components of the second cylinder body are arranged in parallel toward the same direction with reference to the crankshaft.

Having such a configuration can shorten a pipe connecting a compression chamber having the highest pressure among the plurality of compression chambers of the first compression part and a compression chamber having the lowest pressure among the plurality of compression chambers of the second compression part.

Further, in the present invention, it is preferred that the first pressing part comprises a plurality of pistons mutually fitted together, being arranged corresponding to the plurality of cylinder components of the first cylinder body and the second pressing part comprises a plurality of pistons mutually fitted together, being arranged corresponding to the plurality of cylinder components of the second cylinder body, wherein the number of the pistons of the second pressing part is smaller than that of the pistons of the first pressing part.

In this configuration, the pressing part is formed from the plurality of pistons, thereby making it easy to produce the pressing part. Further, the compressor can be configured to be advantageous by minimizing the width of the minute gap between the cylinder component and the piston in the compression chamber, in which a higher pressure gas is introduced.

As described above, according to the present invention, the width of a minute gap between a cylinder component and a pressing part can be minimized.

DESCRIPTION OF THE PREFERRED EMBODIMENTS

Hereinafter, a compressor 1 according to one embodiment of the present invention will be described in detail with reference to FIGS. 1 to 4.

Figure 1:
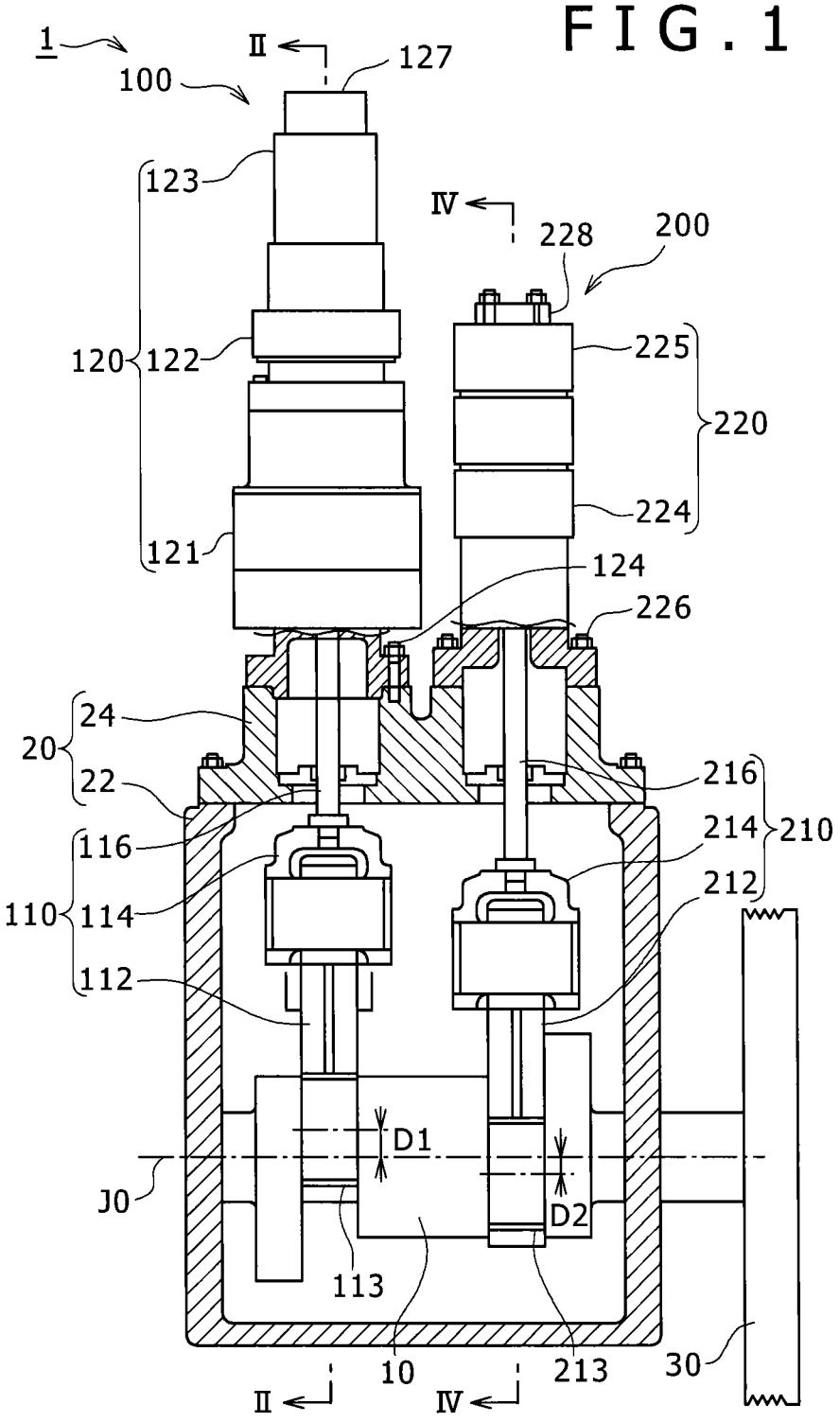
FIG. 1 is a schematic view of a configuration of a compressor according to one embodiment of the present invention.

As shown in FIG. 1, the compressor 1 comprises a crankshaft 10, a crankcase 20, a first compression part 100 for compressing a gas, and a second compression part 200 for further compressing the gas compressed in the first compression part 100.

The crankshaft 10 is held by the crankcase 20 so as to be rotatable around a specific rotation center axis JO. In the present embodiment, the crankcase 20 holds the crankshaft 10 and also includes an upward opened box-shaped body 22 and a lid part 24 of a shape of blocking the opening of the body 22, shown in FIG. 1. It is noted that a vertical direction in FIG. 1 corresponds to a gravity direction.

A pulley 30 is connected at one end of the crankshaft 10 outside of the crankcase 20. The pulley 30 is connected to a motor as a driving source (not illustrated) via a transmitting member such as a belt.

Figure 2:
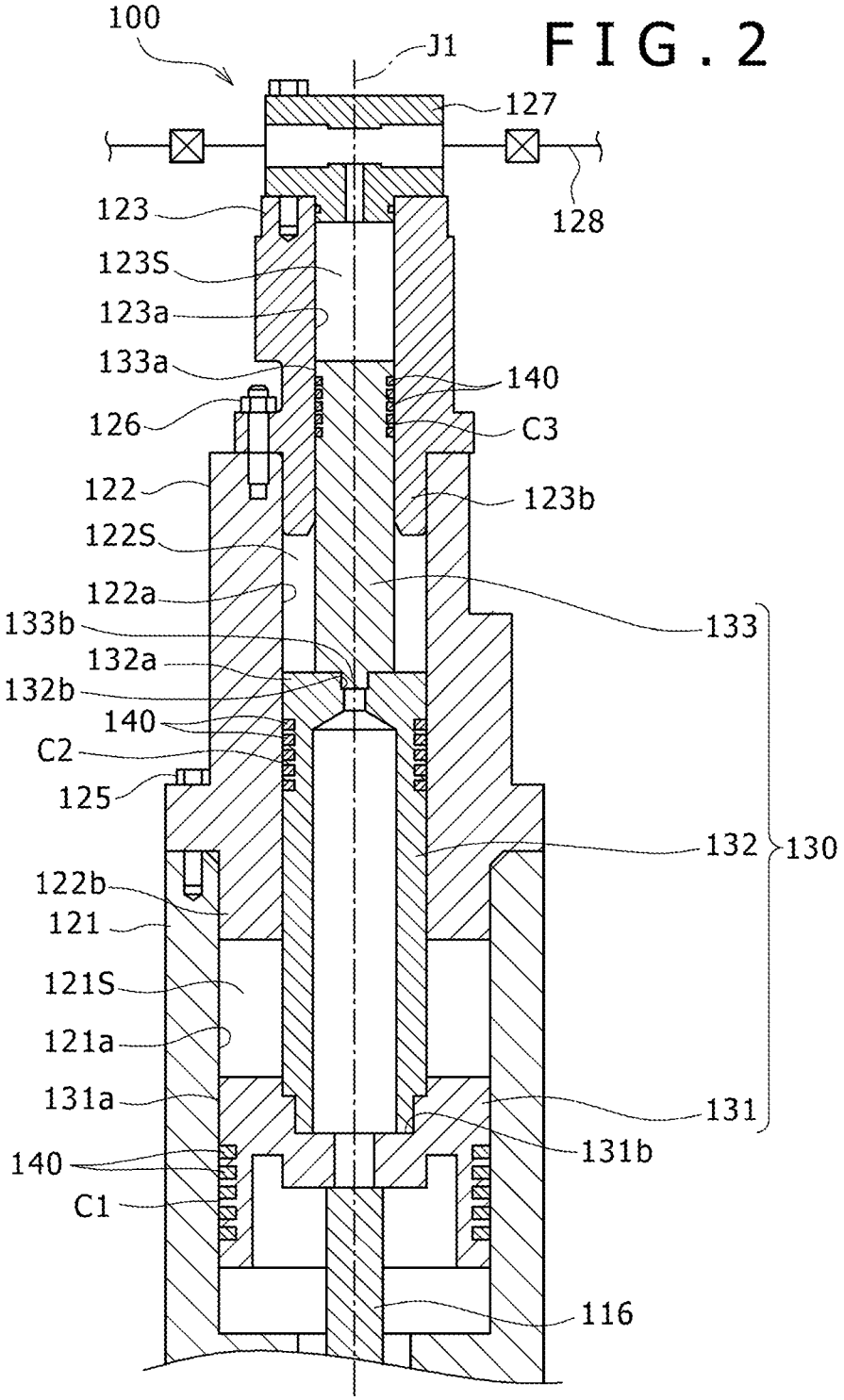
FIG. 2 is a cross-section view taken along the line II-II of FIG. 1.

The first compression part 100 comprises a first reciprocating motion conversion part 110, a first cylinder body 120, a first pressing part 130 (See FIG. 2), and a plurality of first ring member groups 140 (See FIG. 2).

The first reciprocating motion conversion part 110 comprises a first connecting rod 112, a first crosshead 114, and a first piston rod 116.

The first connecting rod 112 comprises a first annular part 113 connected to the crankshaft 10 while being allowed to rotate relatively therewith. The first connecting rod 112 is connected to the crankshaft 10 in a state that a center of the first annular part 113 is eccentric from the rotation center axis JO of the crankshaft 10.

The first crosshead 114 is connected at one end of the first connecting rod 112 on the opposite side where the first annular part 113 is disposed. The first crosshead 114 is formed into a shape of being guided by the crankcase 20 so as to move linearly in a direction orthogonal to the rotation center axis JO of the crankshaft 10 (a vertical direction in FIG. 1) when the crankshaft 10 rotates. In essence, the first connecting rod 112 and the first crosshead 114 convert rotary motion of the crankshaft 10 into linear reciprocating motion. The first connecting rod 112 and the first crosshead 114 are stored in the body 22 of the crankcase 20.

The first piston rod 116 is a cylindrical member and connected to the first crosshead 114. Thus, the first piston rod 116 also performs linear reciprocating motion with the rotation of the crankshaft 10. The first piston rod 116 is extended through the lid part 24 of the crankcase 20 and an upper end part of the first piston rod 116 is positioned above the crankcase 20.

As shown in FIG. 2, the first cylinder body 120 comprises a first cylinder component 121, a second cylinder component 122, and a third cylinder component 123. The first cylinder component 121, the second cylinder component 122, and the third cylinder component 123 are mutually fitted together and arranged in the order along a gravity direction (i.e., a moving direction of the first pressing part 130). A first compression chamber 121S is formed inside the first cylinder component 121. A second compression chamber 122S is formed inside the second cylinder component 122. A third compression chamber 123S is formed inside the third cylinder component 123. In the first compression part 100, a gas suction volume is reduced in the order of the first compression chamber 121S, the second compression chamber 122S, and the third compression chamber 123S.

The first cylinder component 121 is a cylindrical member and includes an inner peripheral surface 121*a* having a circular cross-section in a direction orthogonal to a center axis J1 of the first compression part 100. As shown in FIG. 1, a lower end part of the first cylinder component 121 is inserted into a hole provided in the lid part 24 of the crankcase 20 and fixed to the lid part 24 using a fastener 124 such as a bolt.

As shown in FIG. 2, the second cylinder component 122 is a cylindrical member and includes an inner peripheral surface 122*a* having a circular cross-section in a direction orthogonal to the center axis J1. The second cylinder component 122 is provided with a cylindrical projecting part 122*b* projecting downward. The projecting part 122*b* is inserted in an upper part of the first cylinder component 121. The projecting part 122*b* is abutted with the inner peripheral surface 121*a* of the first cylinder component 121 in a direction orthogonal to the center axis J1. The second cylinder component 122 is fixed to the first cylinder component 121 using a fastener 125 such as a bolt.

The third cylinder component 123 is a cylindrical member and includes an inner peripheral surface 123*a* having a circular cross-section in a direction orthogonal to the center axis J1. The third cylinder component 123 is provided with a cylindrical projecting part 123*b* projecting downward. The projecting part 123*b* is inserted in an upper part of the second cylinder component 122. The projecting part 123*b* is abutted with the inner peripheral surface 122*a* of the second cylinder component 122 in a direction orthogonal to the center axis J1. The third cylinder component 123 is fixed to the second cylinder component 122 using a fastener 126 such as a bolt.

As shown above, the first compression part 100 has such a structure that a cylinder component on an upper side is inserted in a cylinder component on a lower side, thus an inner diameter of the second cylinder component 122 is smaller than that of the first cylinder component 121 and an inner diameter of the third cylinder component 123 is smaller than that of the second cylinder component 122.

The first pressing part 130 comprises a first piston 131, a second piston 132, and a third piston 133. The first to third pistons 131 to 133 are mutually fitted together in a state of being arranged in the order toward an upper side in a gravity direction. The first to third pistons 131 to 133 are arranged corresponding to the first to third cylinder components 121 to 123. The first piston 131 is disposed inside the first cylinder component 121. The second piston 132 is disposed inside the second cylinder component 122. The third piston 133 is disposed inside the third cylinder component 123.

The first piston 131 includes an outer peripheral surface 131*a*, which is a cylindrical surface. The first piston 131 is connected to an upper end part of the first piston rod 116. A concave part 131*b* is formed at an upper end part of the first piston 131, i.e., at a front end part of the first piston 131.

Figure 3:
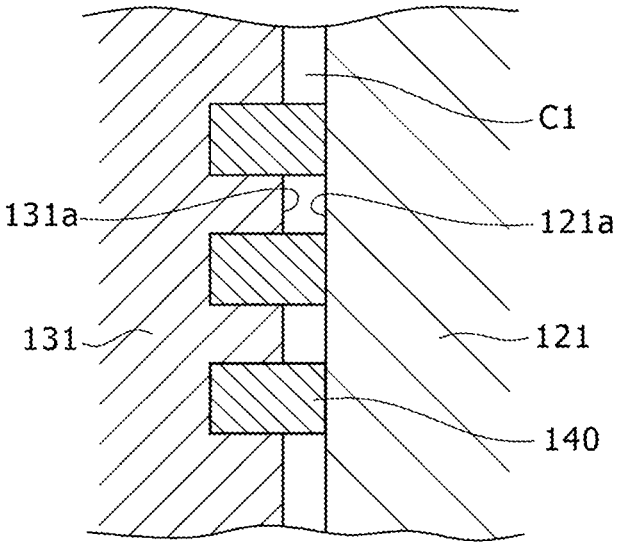
FIG. 3 is an enlarged view between a first piston and a fist cylinder component.

As shown in FIG. 3, a very small gap (hereinafter referred to as "minute gap C1") is formed between the outer peripheral surface 131*a* of the first piston 131 and the inner peripheral surface 121*a* of the first cylinder component 121. The minute gap C1 is provided with the first ring member group 140 composed of a plurality of ring members. The first ring member group 140 is fitted in a plurality of annular groove parts 5 formed on the outer peripheral surface 131*a* of the first piston 131. As shown in FIG. 2, installation of the first ring member group 140 can prevent a gas introduced into the first compression chamber 121S from leaking out of the minute gap C1.

The second piston 132 includes an outer peripheral surface 132*a*, which is a cylindrical surface. A diameter of the outer peripheral surface 132*a* is smaller than that of the cylindrical surface 131*a* of the first piston 131. A lower end part of the second piston 132 is inserted into the concave part 131*b* of the first piston 131. A concave part 132*b* is formed at an upper end part of the second piston 132.

A minute gap C2 is formed between the outer peripheral surface 132*a* of the second piston 132 and the inner peripheral surface 122*a* of the second cylinder component 122. As the minute gap C1, the minute gap C2 is provided with a first ring member group 140 composed of a plurality of ring members. The first ring member group 140 is fitted in a plurality of annular groove parts 5 formed on the outer peripheral surface 132*a* of the second piston 132. Having such a configuration can prevent a gas introduced into the second compression chamber 122S from leaking out of the minute gap C2.

The third piston 133 includes an outer peripheral surface 133*a*, which is a cylindrical surface. A diameter of the outer peripheral surface 133*a* is smaller than that of the outer peripheral surface 132*a* of the second piston 132. A projecting part 133*b* is formed at a lower part of the third piston 133. The projecting part 133*b* is inserted into the concave part 132*b* of the second piston 132. A minute gap C3 is formed between the outer peripheral surface 133*a* of the third piston 133 and the inner peripheral surface 123*a* of the third cylinder component 123. As the minute gaps C1 and C2, the minute gap C3 is provided with a first ring member group 140. The first ring member group 140 is fitted in a plurality of annular groove parts 5 formed on the outer peripheral surface 133*a* of the third piston 133. Installation of the first ring member group 140 can prevent a gas introduced into the third compression chamber 123S from leaking out of the minute gap C3. A connection member 127 is attached to an upper part of the third cylinder component 123.

In the compression part 100, the first cylinder body 120 is formed from the three cylinder components 121 to 123, thus the first cylinder body 120 can be accurately and easily produced as compared with a compression part in which a cylinder body is formed from a single member. Similarly, the first pressing part 130 is formed from the three pistons 131 to 133, thus the first pressing part 130 can be accurately and easily produced as compared with a compression part in which a pressing part is formed from a single member.

Figure 4:
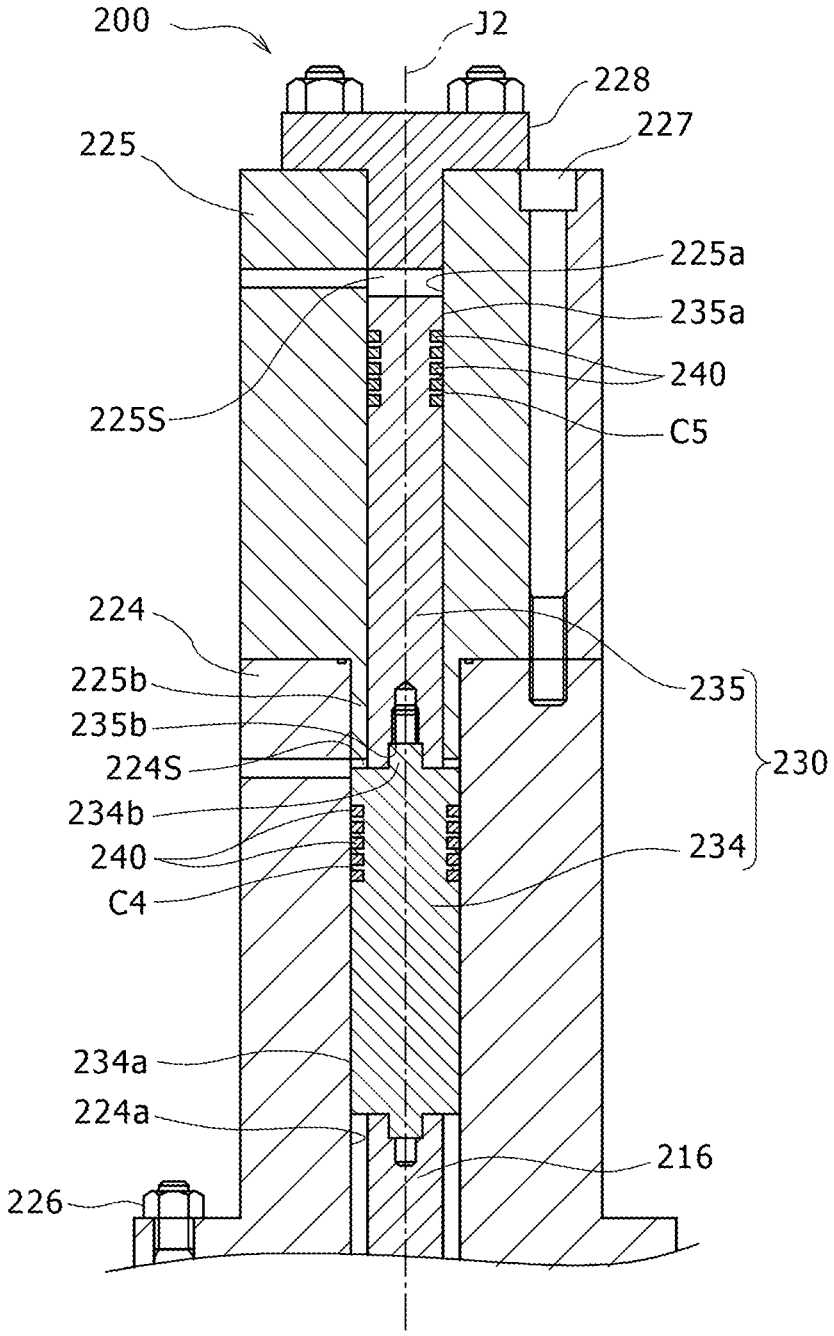
FIG. 4 is a cross-section view taken along the line IV-IV of FIG. 1.

As shown in FIG. 1, a second compression part 200 comprises a second reciprocating motion conversion part 210, a second cylinder body 220, a second pressing part 230 (See FIG. 4), and a plurality of second ring member groups 240 (See FIG. 4).

The second reciprocating motion conversion part 210 has basically the same structure as the first reciprocating motion conversion part 110. That is, the second reciprocating motion conversion part 210 comprises a second connecting rod 212 having a second annular part 213 connected to the crankshaft 10, a second crosshead 214 connected to the second connecting rod 212, and a second piston rod 216 connected to the second crosshead 214.

The second connecting rod 212 is connected to the crankshaft 10 at a position separated from the first connecting rod 112 in an axial direction of the crankshaft 10. A distance D2 between a center of the second annular part 213 and the rotation center axis JO of the crankshaft 10 is set to be smaller than a distance D1 between a center of the first annular part 113 and the rotation center axis JO of the crankshaft 10. That is, a stroke of the second reciprocating motion conversion part 210 is set to be smaller than that of the first reciprocating motion conversion part 110.

As shown in FIG. 4, the second cylinder body 220 comprises a fourth cylinder component 224 and a fifth cylinder component 225. The fifth cylinder component 225 and the fourth cylinder component 224 are mutually fitted together and arranged in the order along a gravity direction (i.e., a moving direction of the second pressing part 230). A fourth compression chamber 224S is formed inside the fourth cylinder component 224. A fifth compression chamber 225S is formed inside the fifth cylinder component 225. In the second compression part 200, the number of the cylinder components of the second cylinder body 220 is smaller than that of the cylinder components of the first cylinder body 120. That is, the number of the compression chambers 224S and 225S of the second compression part 200 is smaller than that of the compression chambers 121S to 123S of the first compression part 100. In the second compression part 200, a gas suction volume is reduced in the order of the fourth compression chamber 224S and the fifth compression chamber 225S.

The fourth cylinder component 224 is a cylindrical member and includes an inner peripheral surface 224*a* having a circular cross-section in a direction orthogonal to a center axis J2 of the second compression part 200. As shown in FIG. 1, a lower end part of the fourth cylinder component 224 is fixed to the lid part 24 of the crankcase 20 using a fastener 226 such as a bolt.

As shown in FIG. 4, the fifth cylinder component 225 is a cylindrical member and includes an inner peripheral surface 225*a* having a circular cross-section in a direction orthogonal to the center axis J2. The fifth cylinder component 225 is provided with a cylindrical projecting part 225*b* projecting downward. The projecting part 225*b* is inserted in an upper part of the fourth cylinder component 224. The projecting part 225*b* is abutted with the inner peripheral surface 224*a* of the fourth cylinder component 224 in a direction orthogonal to the center axis J2. The fifth cylinder component 225 is fixed to the fourth cylinder component 224 using a fastener 227 such as a bolt.

The second compression part 200, like the first compression part 100, has such a structure that a cylinder component on an upper side is inserted in a cylinder component on a lower side, thus an inner diameter of the fifth cylinder component 225 is smaller than that of the fourth cylinder component 224.

The second pressing part 230 comprises a fourth piston 234 and a fifth piston 235. The fourth piston 234 and the fifth piston 235 are mutually fitted together in a state of being arranged in the order toward an upper side in a gravity direction. The fourth and fifth pistons 234 and 235 are arranged corresponding to the fourth and fifth cylinder components 224 and 225. The fourth piston 234 is disposed inside the fourth cylinder component 224. The fifth piston 235 is disposed inside the fifth cylinder component 225.

The fourth piston 234 includes an outer peripheral surface 234*a*, which is a cylindrical surface. A lower end part of the fourth piston 234 is connected to an upper end part of the second piston rod 216. A convex part 234*b* is formed at an upper end part of the fourth piston 234, i.e., at a front end part of the fourth piston 234.

A minute gap C4 is formed between the outer peripheral surface 234*a* of the fourth piston 234 and the inner peripheral surface 224*a* of the fourth cylinder component 224. The minute gap C4 is smaller than the minute gap C3 of the first compression part 100. The minute gap C4 is provided with a second ring member group 240 composed of a plurality of ring members. The second ring member group 240 is fitted in a plurality of annular groove parts 5 formed on the outer peripheral surface 234*a* of the fourth piston 234. Installation of the second ring member group 240 can prevent a gas introduced into the fourth compression chamber 224S from leaking out of the minute gap C4.

The fifth piston 235 includes an outer peripheral surface 235*a*, which is a cylindrical surface. A diameter of the outer peripheral surface 235*a* is smaller than that of the outer peripheral surface 234*a* of the fourth piston 234. A concave part 235*b* is formed at a lower end part of the fifth piston 235. The convex part 234*b* of the fourth piston 234 is inserted into the concave part 235*b*.

A minute gap C5 is formed between the outer peripheral surface 235*a* of the fifth piston 235 and the inner peripheral surface 225*a* of the fifth cylinder component 225. The minute gap C5 is provided with a second ring member group 240 composed of a plurality of ring members. The second ring member group 240 is fitted in a plurality of annular groove parts 5 formed on the outer peripheral surface 235*a* of the fifth piston 235. Installation of the second ring member group 240 can prevent a gas introduced into the fifth compression chamber 225S from leaking out of the minute gap C5. A closing member 228 is attached to an upper part of the fifth cylinder component 225.

In the second compression part 200, the second cylinder body 220 is formed from the two cylinder components 224 and 225, thus the second cylinder body 220 can be accurately and easily produced. Similarly, the second pressing part 230 is formed from the two pistons 234 and 235, thus the second pressing part 230 can be accurately and easily produced.

In the compressor 1, a plurality of the cylinder components 121, 122, and 123 of the first cylinder body 120 and a plurality of the cylinder components 224 and 225 of the second cylinder body 220 are arranged in parallel toward the same direction (upward in a gravity direction) with reference to the crankshaft 10. Having such a configuration can shorten a pipe connecting the third compression chamber 123S of the first compression part 100 and the fourth compression chamber 224S of the second compression part 200.

When the compressor 1 is driven, a gas compressed by the first piston 131 in the first compression chamber 121S shown in FIG. 2 is allowed to flow into the second compression chamber 122S via a pipe, not illustrated, provided outside the first cylinder body 120. The gas compressed by the second piston 132 in the second compression chamber 122S is allowed to flow into the third compression chamber 123S via a pipe, not illustrated, provided outside the first cylinder body 120. The gas compressed by the third piston 133 in the third compression chamber 123S is sent to the second compression part 200 through a passage formed inside the connection member 127 and a pipe 128 connected to this passage. When a high-pressure gas is compressed in the first compression part 100, the gas tends to leak out of the compression chambers, thus the width of the minute gaps in a direction orthogonal to the center axis J1 is reduced in the order of the minute gap C1 of the first compression chamber 121S, the minute gap C2 of the second compression chamber 122S, and the minute gap C3 of the third compression chamber 123S.

As shown in FIG. 4, a gas compressed in the third compression chamber 123S of the third cylinder component 123 is allowed to flow into the fourth compression chamber 224S via a pipe, not illustrated, provided outside the second cylinder body 220. The gas compressed by the fourth piston 234 of the fourth compression chamber 2245 is allowed to flow into the fifth compression chamber 225S of the fifth cylinder component 225 via a pipe, not illustrated, provided outside the second cylinder body 220. The gas compressed by the fifth piston 235 in the fifth compression chamber 225S is supplied to the outside through a pipe not illustrated.

Also in the second compression part 200, when a high-pressure gas is compressed, the gas tends to leak out of the compression chambers, thus the width of the minute gaps in a direction orthogonal to the center axis J2 is reduced in the order of the minute gap C4 of the fourth compression chamber 224S and the minute gap C5 of the fifth compression chamber 225S. Further, a higher pressure gas is compressed in the second compression part 200 as compared to the first compression part 100, thus the width of the minute gaps C4 and C5 of the fourth compression chamber 224S and the fifth compression chamber 225S is set to be smaller than that of the minute gaps C1 to C3 of the first to third compression chambers 121S to 123S.

As has been explained on the compressor 1, when a cylinder body has such a structure that a plurality of cylinder components are mutually fitted together, the cylinder body is assembled in consideration of variation of inner and outer diameters of the each cylinder component, thus making it difficult to minimize the width of a minute gap at a upper part of the cylinder body after assembling. The same logic is applied to a case where a pressing part is assembled from a plurality of pistons.

To cope with this, in the compressor 1, the number of the cylinder components 224 and 225 in the second compression part 200, in which a high-pressure gas is introduced, is set to be smaller than that of the cylinder components 121 to 123 in the first compression part 100, in which a low-pressure gas is introduced. As a result, in the second compression part 200, the number of cylinder components disposed at a position lower than the fifth cylinder component 225 is reduced, whereby the minute gap C5 between the fifth cylinder component 225 and the fifth piston 235 is easily minimized. Furthermore, the width of the minute gap C5 is settled within an acceptable range set in view point of preventing gas leakage or reducing excessive force acting on the second ring member groups 240.

Similarly, the number of the pistons 234 and 235 of the second pressing part 230 is set to be smaller than that of the pistons 131 to 133 of the first pressing part 130. As a result, in the second compression part 200, the number of pistons disposed at a position lower than the fifth piston 235 is reduced, whereby the width of the minute gap C5 is easily minimized. By minimizing the width of the minute gap C5, the wear of the second ring member groups 240 is suppressed.

In this regard, if a compression part having only the fifth compression chamber is separately provided, the size of various devices of a compressor is increased and it becomes difficult to secure the installation area. In contrast, in the compressor 1, the minute gaps can be properly determined while preventing an increase in the installation area.

Also, in the compressor 1, a stroke of the second pressing part 230 is set to be smaller than that of the first pressing part 130, thus the wear of the second ring member groups 240 of the second pressing part 230 can be further suppressed.

The first ring member groups 140 are fitted to the first pressing part 130 and the second ring member groups 240 are fitted to the second pressing part 230, thus the wear of the ring member groups 140 and 240 is reduced as compared with a case where each of the ring member groups 140 and 240 is attached to an inner surface of each of the corresponding cylinder components.

The embodiment of the present invention has been explained above. It is noted that the embodiment disclosed herein is exemplary in every aspect and should be understood as non-limiting. It is intended that the scope of the present invention is defined not by the foregoing embodiment but by the scope of the claims, and any modification within the scope of the claims or equivalent in meaning to the scope of the claims is included in the scope of the present invention.

For example, in the above embodiment, the first compression part 100 and the second compression part 200 may be arranged in a horizontal direction. Even in this configuration, the width of a minute gap between a cylinder component and a pressing part at a front end side of the second compression part 200 can be minimized by setting the number of cylinder components of the second compression part 200 to be smaller than that of cylinder components of the first compression part 100. Furthermore, the first compression part 100 and the second compression part 200 may be arranged in opposite directions with reference to the crankshaft 10.

The first compression part 100 of the above embodiment may have such a structure that a gas pressure is gradually increased as it goes from a compression chamber at a front end, i.e., the one farthest from the crankshaft 10, to a compression chamber near the crankshaft 10. The same configuration may be also applied to the second compression part 200.

Each of the first ring member groups 140 may be fitted into the inner peripheral surface 121*a* of the first cylinder component 121, the inner peripheral surface 122*a* of the second cylinder component 122, and the inner peripheral surface 123*a* of the third cylinder component 123. Each of the pressing parts 130 and 230 may be composed of plungers instead of pistons.

In the above embodiment, when six or more compression chambers are provided, three or more compression parts may be provided. In this case, it is preferred that a relation between a compression part having two or more cylinder components and a next compression part having two or more cylinder components for further compressing a gas discharged from the compression part is equivalent to a relation between the first compression part 100 and the second compression part 200 described above. That is, the width of a minute gap between a cylinder component and a piston of the next compression part can be minimized by setting the number of the cylinder components of the next compression part to be smaller than that of the cylinder components of the compression part.

The compressor 1 can efficiently compress hydrogen having a small molecular weight, thus easily leaking out of a compression chamber. The compressor 1 can be also used for compressing a gas other than hydrogen.

What is claimed is:

1. A compressor comprising:

a crankshaft;

a first compression part for compressing a gas: and a second compression part for further compressing the gas discharged from the first compression part, wherein the first compression part comprises:

a first reciprocating motion conversion part including a first connecting rod directly connected at a first end to the crankshaft to rotate with the crankshaft, a first crosshead directly connected to a second end of the first connecting rod to move linearly in a direction orthogonal to a rotation axis of the crankshaft, and a first piston rod directly connected at a first end to the first crosshead to linearly reciprocate with a rotation of the crankshaft;

a first pressing part directly connected to a second end of the first piston rod of the first reciprocating motion conversion part, capable of compressing a gas; and a first cylinder body for storing the first pressing part, the first cylinder body comprising cylinder components, including a first cylinder component having a first compression chamber, a second cylinder component having a second compression chamber, and a third cylinder component having a third compression chamber, mutually fitted together in a state of being arranged co-axially and along a moving direction of the first pressing part, allowing a gas compression by the first pressing part moving within the first cylinder component, the second cylinder component, and the third cylinder component of the first cylinder body, and the second compression part comprises:

a second reciprocating motion conversion part connected to the crankshaft, linearly reciprocating with a rotation of the crankshaft;

a second pressing part connected to the second reciprocating motion conversion part, capable of compressing a gas; and a second cylinder body for storing the second pressing part, the second cylinder body comprising cylinder components, including a fourth cylinder component having a fourth compression chamber and a fifth cylinder component having a fifth compression chamber, mutually fitted together in a state of being arranged co-axially and along a moving direction of the second pressing part, allowing a gas compression by the second pressing part moving within the fourth cylinder component and the fifth cylinder component of the second cylinder body, wherein an inner diameter of the second cylinder component is smaller than an inner diameter of the first cylinder component, and an inner diameter of the third cylinder component is smaller than the inner diameter of the second cylinder component, wherein an inner diameter of the fifth cylinder component is smaller than an inner diameter of the fourth cylinder component, wherein a total number of the cylinder components that comprise the second cylinder body is smaller than a total number of the cylinder components that comprise the first cylinder body.

2. The compressor according to claim 1, wherein:

the first compression part further comprises a first group of first ring members disposed between an inner peripheral surface of the first cylinder component and the first pressing part, a second group of the first ring members disposed between an inner peripheral surface of the second cylinder component and the first pressing part, and a third group of the first ring members disposed between an inner peripheral surface of the third cylinder component and the first pressing part; and the second compression part further comprises a first group of second ring members disposed between an inner peripheral surface of the fourth cylinder component and the second pressing part and a second group of the second ring members disposed between an inner peripheral surface of the fifth cylinder component and the second pressing part.

3. The compressor according to claim 1, wherein a stroke of the second pressing part is set to be smaller than a stroke of the first pressing part.

4. The compressor according to claim 2, wherein:

the first group of the first ring members, the second group of the first ring members, and the third group of the first ring members are fitted in annular grooves formed on outer peripheral surfaces of the first pressing part; and the first group of the second ring members and the second group of the second ring members are fitted in annular grooves formed on outer peripheral surfaces of the second pressing part.

5. The compressor according to claim 1, wherein the cylinder components of the first cylinder body and the cylinder components of the second cylinder body are arranged in parallel toward the same direction with reference to the crankshaft.

6. The compressor according to claim 1, wherein:

the first pressing part comprises at least three pistons mutually fitted together, including a first piston arranged in the first cylinder component, a second piston arranged in the second cylinder component, and a third piston arranged in the third cylinder component;

the second pressing part comprises at least two pistons mutually fitted together, including a fourth piston arranged in the fourth cylinder component, and a fifth piston arranged in the fifth cylinder component; and a number of the pistons of the second pressing part is smaller than a number of the pistons of the first pressing part.

7. The compressor according to claim 6, wherein:

a first gap is provided between an outer peripheral surface of the first piston and an inner peripheral surface of the first cylinder component, a second gap is provided between an outer peripheral surface of the second piston and an inner peripheral surface of the second cylinder component, the second gap being smaller than the first gap, a third gap is provided between an outer peripheral surface of the third piston and an inner peripheral surface of the third cylinder component, the third gap being smaller than the second gap, a fourth gap is provided between an outer peripheral surface of the fourth piston and an inner peripheral surface of the fourth cylinder component, the fourth gap being smaller than the third gap, and a fifth gap is provided between an outer peripheral surface of the fifth piston and an inner peripheral surface of the fifth cylinder component, the fifth gap being smaller than the fourth gap.

8. The compressor according to claim 1, wherein:

the second cylinder component includes a cylinder projecting part at a first end of the second cylinder component, the cylinder projecting part of the second cylinder component being positioned in a first end of the first cylinder component such that the cylinder projecting part of the second cylinder component directly contacts an inner peripheral surface of the first cylinder component, the third cylinder component includes a cylinder projecting part at a first end of the third cylinder component, the cylinder projecting part of the third cylinder component is positioned in a second end of the second cylinder component such that the cylinder projecting part of the third cylinder component directly contacts an inner peripheral surface of the second cylinder component, and the fifth cylinder component includes a cylinder projecting part at a first end of the fifth cylinder component, the cylinder projecting part of the fifth cylinder component is positioned in a first end of the fourth cylinder component such that the cylinder projecting part of the fifth cylinder component directly contacts an inner peripheral surface of the fourth cylinder component.

9. The compressor according to claim 1, wherein:

the first pressing part comprises at least three pistons mutually fitted together, including a first piston arranged in the first cylinder component, a second piston arranged in the second cylinder component, and a third piston arranged in the third cylinder component; and the first piston includes a concave part in an upper end of the first piston and a lower end part of the second piston is inserted into the concave part of the first piston.

10. The compressor according to claim 9, wherein:

the second piston includes a concave part in an upper end of the second piston and a lower end part of the third piston is inserted into the concave part of the second piston.

11. The compressor according to claim 9, wherein:

the second end of the first piston rod is connected to a lower end of the first piston.

12. The compressor according to claim 1, wherein:

the crankshaft, the first connecting rod, and the first crosshead are positioned within a crankcase;

the first pressing part and the first cylinder body are positioned outside of the crankcase; and the first piston rod extends through a lid part of the crankcase such that the second end of the first piston rod is positioned above the crankcase and in direct contact with a first piston of the first pressing part.

13. A compressor comprising:

a crankshaft;

a first compression part for compressing a gas: and a second compression part for further compressing the gas discharged from the first compression part, wherein the first compression part comprises:

a first reciprocating motion conversion part including a first connecting rod connected to the crankshaft to rotate with the crankshaft, a first crosshead directly connected to the first connecting rod to move linearly in a direction orthogonal to a rotation axis of the crankshaft, and a first piston rod directly connected at a first end to the first crosshead to linearly reciprocate with a rotation of the crankshaft;

a first pressing part directly connected to a second end of the first piston rod of the first reciprocating motion conversion part, capable of compressing a gas; and a first cylinder body for storing the first pressing part, the first cylinder body comprising cylinder components, including a first cylinder component having a first compression chamber, a second cylinder component having a second compression chamber, and a third cylinder component having a third compression chamber, mutually fitted together in a state of being arranged co-axially and along a moving direction of the first pressing part, allowing a gas compression by the first pressing part moving within the first cylinder component, the second cylinder component, and the third cylinder component of the first cylinder body, and the second compression part comprises:

a second reciprocating motion conversion part connected to the crankshaft, linearly reciprocating with a rotation of the crankshaft;

a second pressing part connected to the second reciprocating motion conversion part, capable of compressing a gas; and a second cylinder body for storing the second pressing part, the second cylinder body comprising cylinder components, including a fourth cylinder component having a fourth compression chamber and a fifth cylinder component having a fifth compression chamber, mutually fitted together in a state of being arranged co-axially and along a moving direction of the second pressing part, allowing a gas compression by the second pressing part moving within the fourth cylinder component and the fifth cylinder component of the second cylinder body, wherein an inner diameter of the second cylinder component is smaller than an inner diameter of the first cylinder component, and an inner diameter of the third cylinder component is smaller than the inner diameter of the second cylinder component, wherein an inner diameter of the fifth cylinder component is smaller than an inner diameter of the fourth cylinder component, wherein a total number of the cylinder components that comprise the second cylinder body is smaller than a total number of the cylinder components that comprise the first cylinder body, wherein:

the first pressing part comprises at least three pistons mutually fitted together, including a first piston arranged in the first cylinder component, a second piston arranged in the second cylinder component, and a third piston arranged in the third cylinder component; and the first piston includes a concave part in an upper end of the first piston and a lower end part of the second piston is inserted into the concave part of the first piston.

14. The compressor according to claim 13, wherein:

the second piston includes a concave part in an upper end of the second piston and a lower end part of the third piston is inserted into the concave part of the second piston.

15. The compressor according to claim 13, wherein:

the second end of the first piston rod is connected to a lower end of the first piston.

16. A compressor comprising:

a crankshaft;

a first compression part for compressing a gas: and a second compression part for further compressing the gas discharged from the first compression part, wherein the first compression part comprises:

a first reciprocating motion conversion part including a first connecting rod connected to the crankshaft to rotate with the crankshaft, a first crosshead directly connected to the first connecting rod to move linearly in a direction orthogonal to a rotation axis of the crankshaft, and a first piston rod directly connected at a first end to the first crosshead to linearly reciprocate with a rotation of the crankshaft;

a first pressing part directly connected to a second end of the first piston rod of the first reciprocating motion conversion part, capable of compressing a gas; and a first cylinder body for storing the first pressing part, the first cylinder body comprising cylinder components, including a first cylinder component having a first compression chamber, a second cylinder component having a second compression chamber, and a third cylinder component having a third compression chamber, mutually fitted together in a state of being arranged co-axially and along a moving direction of the first pressing part, allowing a gas compression by the first pressing part moving within the first cylinder component, the second cylinder component, and the third cylinder component of the first cylinder body, and the second compression part comprises:

a second reciprocating motion conversion part connected to the crankshaft, linearly reciprocating with a rotation of the crankshaft;

a second pressing part connected to the second reciprocating motion conversion part, capable of compressing a gas; and a second cylinder body for storing the second pressing part, the second cylinder body comprising cylinder components, including a fourth cylinder component having a fourth compression chamber and a fifth cylinder component having a fifth compression chamber, mutually fitted together in a state of being arranged co-axially and along a moving direction of the second pressing part, allowing a gas compression by the second pressing part moving within the fourth cylinder component and the fifth cylinder component of the second cylinder body, wherein an inner diameter of the second cylinder component is smaller than an inner diameter of the first cylinder component, and an inner diameter of the third cylinder component is smaller than the inner diameter of the second cylinder component, wherein an inner diameter of the fifth cylinder component is smaller than an inner diameter of the fourth cylinder component, wherein a total number of the cylinder components that comprise the second cylinder body is smaller than a total number of the cylinder components that comprise the first cylinder body, wherein:

the crankshaft, the first connecting rod, and the first crosshead are positioned within a crankcase;

the first pressing part and the first cylinder body are positioned outside of the crankcase; and the first piston rod extends through a lid part of the crankcase such that the second end of the first piston rod is positioned above the crankcase and in direct contact with a first piston of the first pressing part.

* * * * *